US006956528B2

(12) United States Patent
Lee et al.

(10) Patent No.: US 6,956,528 B2
(45) Date of Patent: Oct. 18, 2005

(54) BROADBAND DUAL-POLARIZED MICROSTRIP ARRAY ANTENNA

(75) Inventors: Byung-je Lee, Seoul (KR); Gi-cho Kang, Seoul (KR); Hak-yong Lee, Youngcheon-si (KR); Nam-young Kim, Seoul (KR); Jong-heon Kim, Seoul (KR); Guen-ho Lee, Seoul (KR); Keuk-hwan Ra, Seoul (KR)

(73) Assignees: Mission Telecom, Inc., Silver Spring, MD (US); Pawanet, Inc., Seoul (KR); Kwangwoon Foundation, Seoul (KR)

( * ) Notice: Subject to any disclaimer, the term of this patent is extended or adjusted under 35 U.S.C. 154(b) by 0 days.

(21) Appl. No.: 10/476,410

(22) PCT Filed: Jun. 9, 2001

(86) PCT No.: PCT/KR01/00981

§ 371 (c)(1),
(2), (4) Date: Oct. 30, 2003

(87) PCT Pub. No.: WO02/089248

PCT Pub. Date: Nov. 7, 2002

(65) Prior Publication Data

US 2004/0119645 A1 Jun. 24, 2004

(30) Foreign Application Priority Data

Apr. 30, 2001 (KR) ..... 2001-23594
May 2, 2001 (KR) ..... 2001-12659

(51) Int. Cl.[7] ..... H01Q 1/38

(52) U.S. Cl. ..... 343/700 MS

(58) Field of Search ..... 343/700 MS, 829, 343/846, 853

(56) References Cited

U.S. PATENT DOCUMENTS

| | | | | | |
|---|---|---|---|---|---|
| 4,772,890 | A | * | 9/1988 | Bowen et al. | 343/700 MS |
| 4,866,451 | A | | 9/1989 | Chen | |
| 4,943,809 | A | | 7/1990 | Zaghloul | |
| 5,045,862 | A | | 9/1991 | Alden et al. | |
| 5,499,033 | A | * | 3/1996 | Smith | 343/700 MS |
| 5,661,494 | A | * | 8/1997 | Bondyopadhyay | 343/700 MS |
| 5,742,258 | A | * | 4/1998 | Kumpfbeck et al. | 343/795 |
| 5,894,287 | A | | 4/1999 | An et al. | |
| 5,896,107 | A | | 4/1999 | Huynh | |
| 5,898,409 | A | | 4/1999 | Holzman | |
| 5,905,465 | A | | 5/1999 | Olson et al. | |
| 6,377,217 | B1 | * | 4/2002 | Zhu et al. | 343/700 MS |

* cited by examiner

*Primary Examiner*—Tho Phan

(57) ABSTRACT

This invention relates to a microstrip array antenna, especially a broad-band dual-polarized microstrip array antenna having parallel feeding structure whose consist of two parts power supplying layers each of which generates its own polarization respectively. And the broad-band dual-polarized microstrip array antenna according to the present invention arranges transmission paths for two separate linear polarization on a different layer each other in order to minimize an interference effect and a proximity feeding method and an aperture coupled method are used in order to get two separate polarization.

6 Claims, 5 Drawing Sheets

BROADBAND DUAL-POLARIZED MICROSTRIP ARRAY ANTENNA

BACKGROUND OF THE INVENTION

1. Field of the Invention

This invention relates to a microstrip array antenna, especially a broad-band dual-polarized microstrip array antenna having parallel feeding structure whose consist of two parts power supplying layers each of which generates its own polarization respectively.

The broad-band dual-polarized microstrip array antenna according to the present invention arranges transmission paths for two separate linear polarization on a different layer each other in order to minimize an interference effect and a proximity feeding method and an aperture coupled method are used in order to get two separate polarization.

2. Description of the Related Arts

The general microstrip array antennas have used a dielectric substrate as a power supplying substrate having a power supplying line. Therefor the thickness of the system and the manufacturing cost increased. Also, it was possible to receive only one polarization because a patch antenna has an exciting part. Although the patch antenna has two exciting parts in case of using a single power supplying substrate, there is no sufficient space for arranging an exciting transmission line for another polarization, and the bandwidth of the antenna decreases in case of having a serial feeding type transmission line structure, and the transmission line structure becomes complicated and the bandwidth of the antenna decreases in case of having a mixing transmission line structure of the serial feeding type and the parallel feeding type.

FIG. 1 illustrates a traditional microstrip array antenna. In the FIG. 1, the reference number (1) indicates a power input part. After inputted, the power is divided into two transmission lines in the direction of up and down of the power input part (1) and is divided again into two parts in a left and a right direction of a power distributor (2). And the number (3) is an exciting part for transmitting the inputted power to a patch antenna (4). As described in the above, the traditional microstrip array antenna is capable of receiving only one polarization because having only one exciting part (3).

SUMMARY OF THE INVENTION

The present invention was devised to solve the above-mentioned problems and it is an object of this invention to provide a broad-band dual-polarized microstrip array antenna having a parallel feeding type transmission line structure in order to decrease the manufacturing cost by using multiple films instead of a dielectric substrate and in order to generate separate polarization by separating a power supplying layer into two parts.

BRIEF DESCRIPTION OF THE DRAWINGS

The object, other features and advantages of the present invention will become more apparent by reading the preferable embodiment thereof with reference to the accompanying drawings, in which.

100: array antenna

110, 130, 150, 170: film

112: closed region

114, 116: patch antenna

120, 140, 160, 180: styrofoam

DESCRIPTION OF THE PREFFERED EMBODIMENTS

Figure 2:
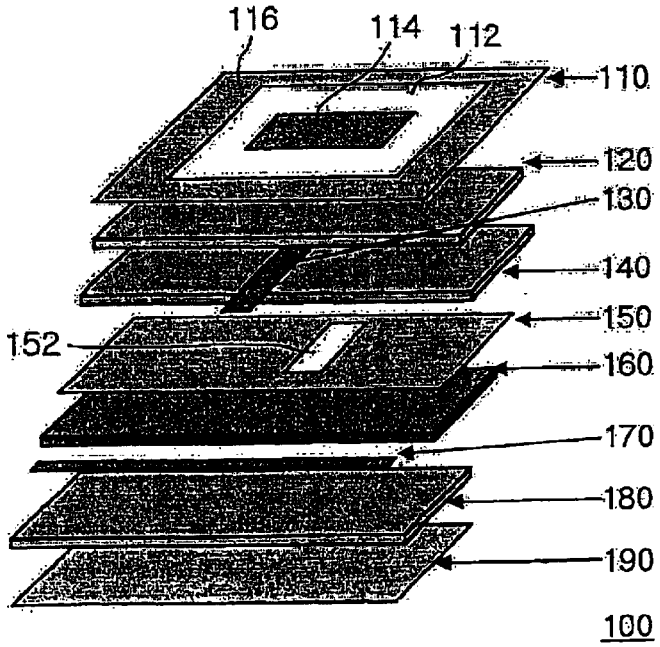
FIG. 2 is an embodiment of the broadband dual-polarized microstrip array antenna according to the present invention.

The broadband dual-polarized microstrip array antenna (100) according to the present invention is shown with reference to the FIG. 2.

The broad-band dual-polarized microstrip array antenna (100) comprises a first film (110), so called "ground", coated with a metal on the upper side of a first film except the inner parts of closed regions (112), multiple of the closed regions arranged in uniform array forms. And the metal coated on the predetermined central regions of the closed regions (112) is removed and patch antenna (114) is formed on the removed central regions of the closed regions (112) and also on the outside region of the closed regions (112) in a first film (110).

In the present invention, the "film" means a thin vinyl film on which metal is coated and its price is cheaper than the traditional dielectric substrate by about 20%.

Figure 1:
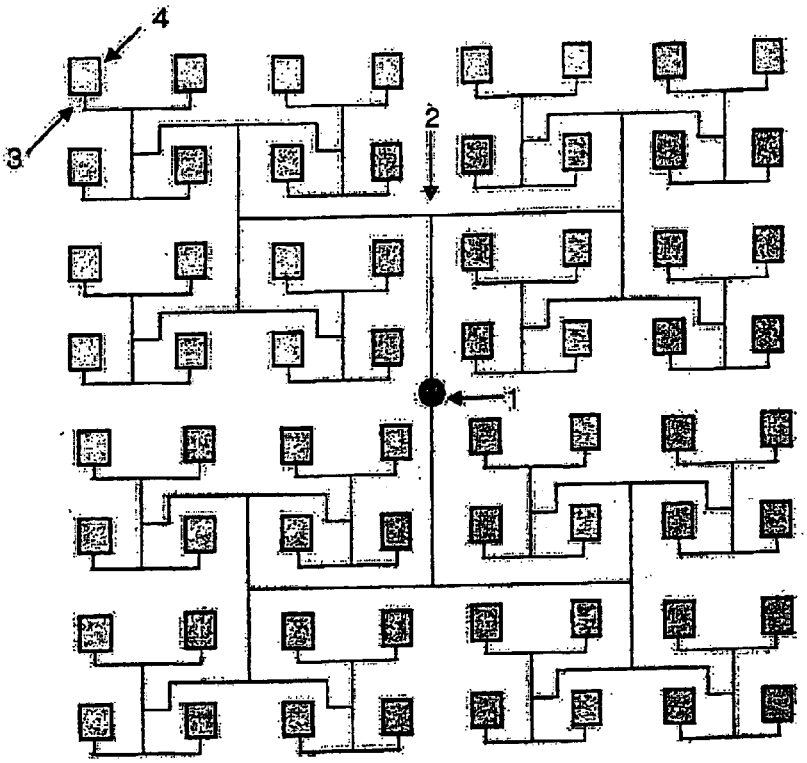
Fig. 1 PRIOR ART
FIG. 1 illustrates a traditional microstrip array antenna.
Figure 3:
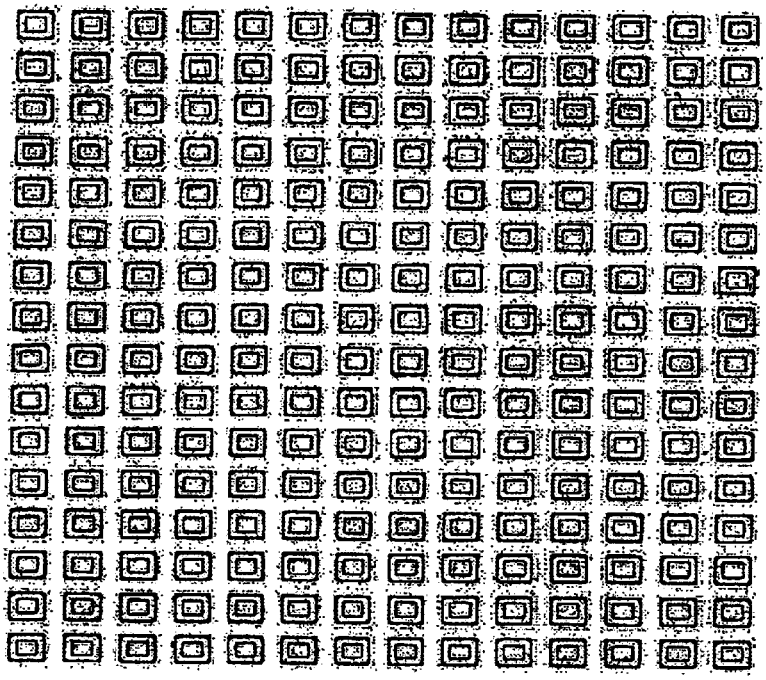
FIG. 3 illustrates an arrangement of patch elements according to the array antenna of the FIG. 2.

The FIG. 3 illustrates a patch antenna layer forming multiple patch antennas having the same structure as it of a first film of FIG. 1. The outside quadrangles of small quadrangles of FIG. 3 are the patch antennas (116) formed on a first film of the FIG. 1, and the inside small quadrangles are the patch antenna (114) formed on the center of the closed regions (112) in a first film (110).

Transmission lines pass beneath a first film (110) (not shown in the FIG. 1.) and a first film (110) plays a role to diminish radiation loss of the transmission lines. The closed region (112) is a region where radiation is occurred by the resonance of the patch antenna (114).

Figure 4:
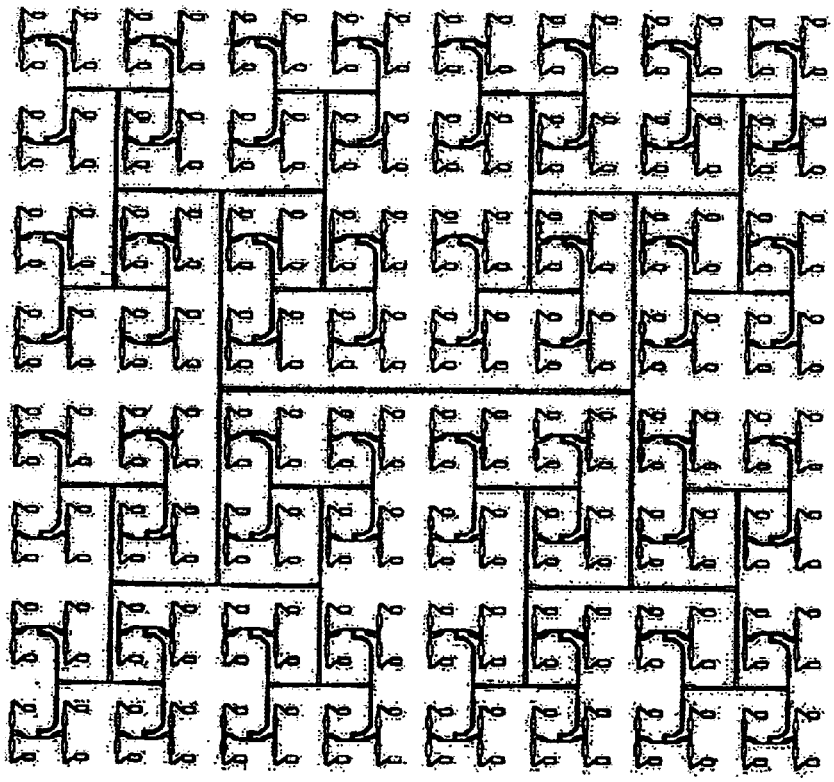
FIG. 4 illustrates an arrangement of transmission line for proximity feeding exciting according to the array antenna of the FIG. 2.

Under a first film, a first styrofoam (120) is formed and a second film (130) is formed under a first styrofoam. As illustrated in FIG. 4, proximity feeding type transmission line layer is formed on a second film and can be excited without direct connection to the patch antenna. And, by using a parallel connecting method and avoiding the closed region (112) of a first film, the transmission line layer formed on a second film prevents the reduction of the bandwidth generated when the array is formed. That is, the transmission line layers formed on a second film are connected in parallel to the bottom side of a first film excepting the closed region (112) and generate a first polarization by exciting each of the patch antennas in accordance with the current inputted from outside. At this time, it is preferable that the thickness of the styrofoam is about 1 mm.

Figure 5:
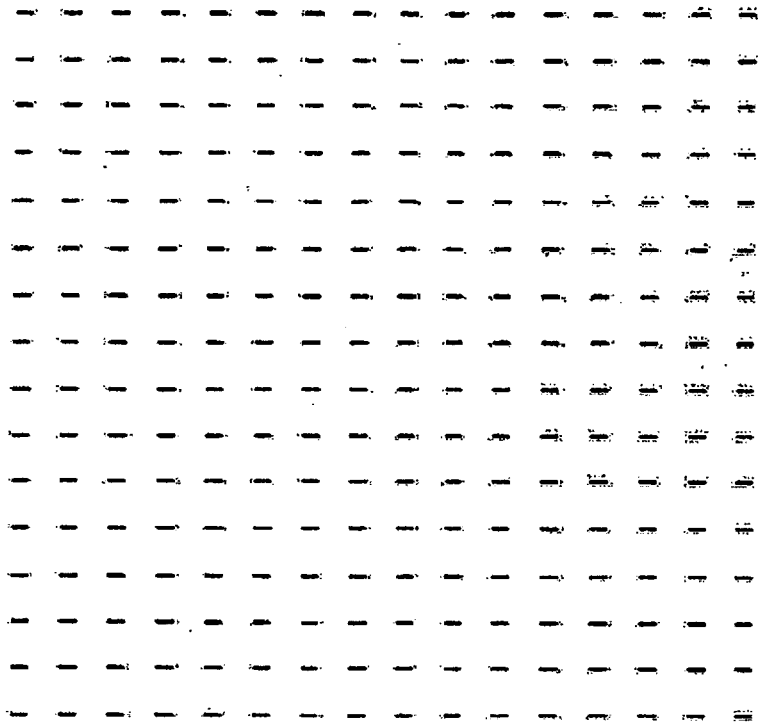
FIG. 5 illustrates a slot layer formed on the third film of the array antenna of the FIG. 2.

Under a second film (130), a second styrofoam (140) is formed and a third film (150) is formed under a second styrofoam (140). A slot (152) is formed on a third film (150) at the corresponding positions to each patch antenna for electro-magnetic wave to pass through. The FIG. 5 illustrates the slot layer (152) formed on a third film (150).

At this time, the surface of a third film (150) except the slot is coated with metal like a first film.

The slot is formed for aperture feeding excitation. And the slot plays a ground role to keep a distance between transmission line formed on the upper side (130) and the bottom side (170) of the ground (150).

Figure 6:
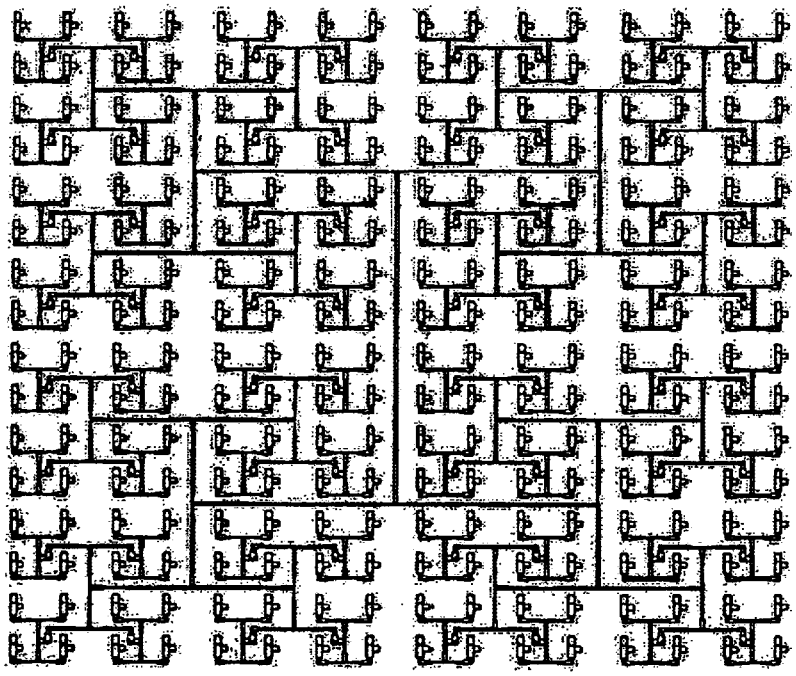
FIG. 6 illustrates aperture feeding type transmission lines on the fourth film according to the array antenna of the FIG. 2.

Under a third film (150), a third styrofoam (160) is formed and a fourth film (170) is formed under a third styrofoam (160). Transmission lines for aperture feeding excitation which are connected in parallel to each other and generate a second polarization by exciting each patch antenna through the slot (152) in accordance with the current inputted from the outside are formed on the bottom layer of a fourth film (170). Under a fourth film (170), a fourth styrofoam (180) is formed and a thin metal plate (190) is formed under a fourth styrofoam (180). That is, the transmission lines for aperture feeding excitation of the patch antenna of a first film (110) are formed on a fourth film (170). And each patch antenna is excited through the slot (152) of the upper ground (150) and a fourth film (170) prevented by the lower metal plate (190) and the upper ground (150) diminishes the radiation loss of the transmission lines. As illustrated in FIG. 4, the present invention can improve the bandwidth of the array antenna by using the parallel connection method. FIG. 6 illustrates aperture feeding type transmission line layer of a fourth film (170). At this time, the proximity feeding excitation transmission line and the aperture feeding excitation transmission line are formed vertically to each other.

Figure 7:
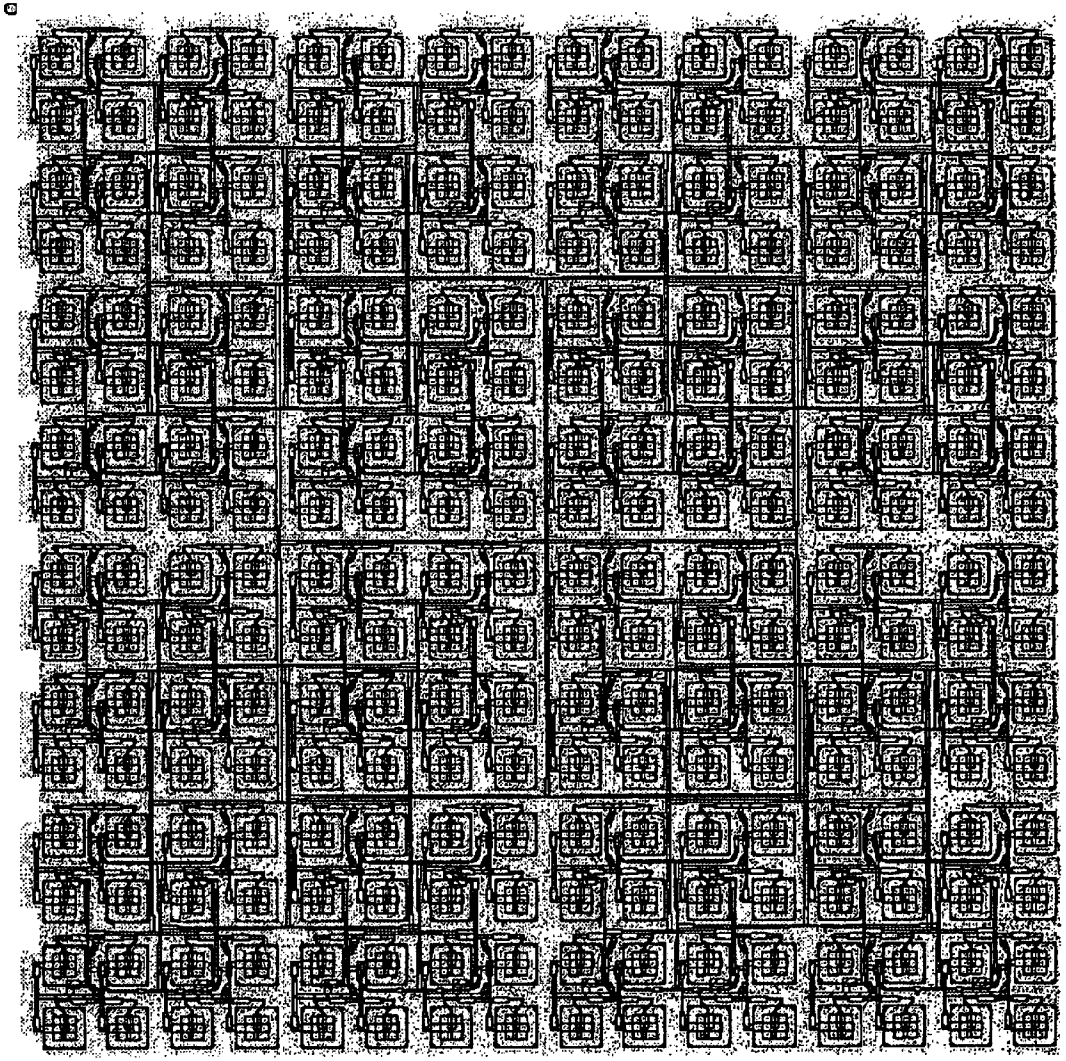
FIG. 7 illustrates an overlapped state of four films of the array antenna of the FIG. 2.
Figure 8:
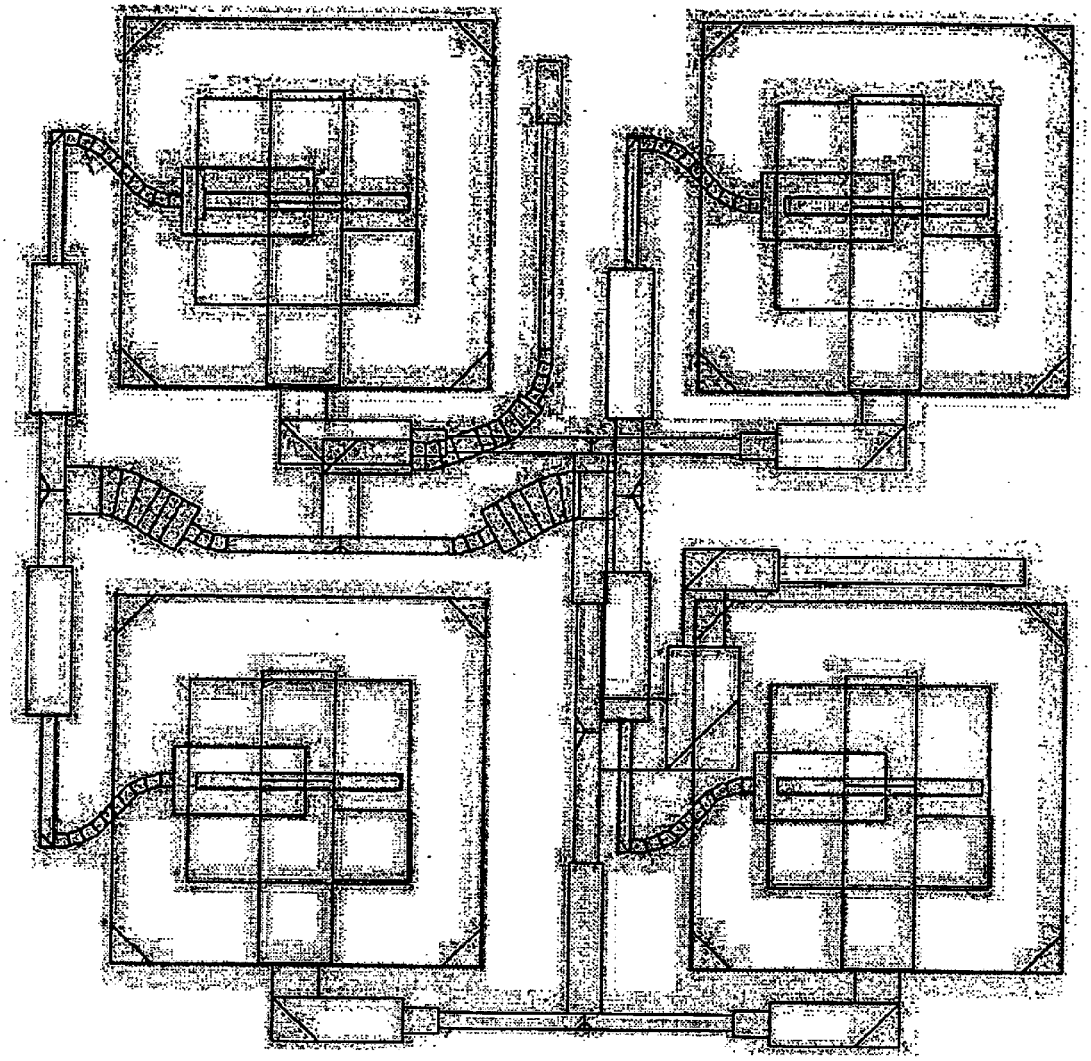
FIG. 8 is a partly enlarged drawing of the FIG. 7.

FIG. 7 illustrates an overlapped state of four films of the array antenna of the FIG. 2 and FIG. 8 is a partly enlarged drawing of the FIG. 7.

The broadband dual-polarized microstrip array antenna according to the present invention separates transmission paths for separate linear polarization into another layers to minimize an interference effect and separates the excitation method into a proximity feeding method and an aperture coupled method in order to get two separate polarization. It is possible to solve the problem of the diminution of the bandwidth of the array antenna appearing in the prior mixing type of the serial and parallel types by arranging the transmission paths for generating separate polarization in other layers each other and by using only a parallel feeding method.

And the present invention using multiple films instead of dielectric substrate for reducing manufacturing cost uses a strip type transmission line structure instead of a microstrip type transmission line structure in order to prevent the transmission loss, which may arise.

And the present invention can prevent the radiation loss of the transmission line because the aperture feeding excitation transmission line is surrounded between the lowest metal plate (190) and a third film (150) and can improve a bandwidth of array antenna by using a parallel connection type transmission line.

And the present invention has a merit of operating antenna by not an electrically direct by connecting the antenna element to each power supplying part but by coupling electro-magnetically.

Although the preferred embodiments of the present invention have been described and illustrated in detail, it will be apparent to those skilled reasons in the art and various modifications and changes may be made thereto without departing from the spirit and the scope of the invention as set forth in the appended claims and equivalents thereof.

What is claimed is:

1. A broadband dual-polarized microstrip array antenna generating two polarizations by using a transmission path, comprising:

a first film coated with metal on an upper side and a plurality of patch elements arranged with a uniform array shape;

a closed region formed in the center of said first film;

a patch antenna formed in the center of said closed region, said catch antenna generating radiation by resonance in said closed region;

a first styrofoam formed under said first film;

a second film forming a proximity feeding excitation transmission line, said second film formed under said first styrofoam and connected in parallel to a bottom side of said first film excepting said closed region, said second film generating a first polarization by exciting each patch antenna in accordance with input current;

a second styrofoam formed under said second film;

a third film under said second styrofoam, wherein a slot is formed at a position corresponding to each patch antenna for electro-magnetic waves to pass through;

a third styrofoam formed under said third film;

a fourth film formed under said third styrofoam, wherein transmission lines for aperture feeding excitation are formed on said fourth film and are connected in parallel to each other and generate a second polarization by exciting each catch antenna through said slot in accordance with the input current;

a fourth styrofoam formed under said fourth film; and a thin metal plate formed under said fourth styrofoam, wherein said two polarizations are generated by a separate transmission path respectively using a parallel feeding method in order to reduce interference between said two polarizations.

2. The array antenna as set forth in claim 1, wherein said separate transmission path is formed on different film layers with respect to each other.

3. The array antenna as set forth in claim 1, wherein a power supplying layer uses a strip line in order to reduce energy loss arising from a power supplying part.

4. The array antenna as set forth in claim 3, wherein said power supplying part and the patch elements are coupled electro-magnetically and operate as an antenna.

5. The array antenna as set forth in claim 4, wherein one of said two polarizations is generated by a patch element using proximity feeding excitation and radiated at a parallel feeding part by said patch element and the other polarization is generated by a patch element using aperture feeding excitation and radiated through the slots of the third film.

6. The array antenna set forth in claim 5, wherein said second film and said fourth film are arranged perpendicular each other on horizontal planes formed by said first styrofoam to said fourth styrofoam.

* * * * *